US005461733A

United States Patent [19]

McKee

[11] Patent Number: 5,461,733

[45] Date of Patent: Oct. 31, 1995

[54] LIFTING DEVICE FOR A COVER AND SEAT ON A BOWL OF A TOILET

[76] Inventor: Eric McKee, 103 Bayberry Rd., Newport, N.C. 28570

[21] Appl. No.: 288,569

[22] Filed: Aug. 10, 1994

[51] Int. Cl.[6] ..... A47K 13/10

[52] U.S. Cl. ..... 4/246.1

[58] Field of Search ..... 4/246.1, 246.3, 4/246.4, 246.5

[56] References Cited

U.S. PATENT DOCUMENTS

| | | | |
|---|---|---|---|
| 752,321 | 2/1904 | Bacon | 4/246.1 |
| 1,308,596 | 7/1919 | Klein | 4/246.1 |
| 2,318,518 | 5/1943 | Opperer | 4/246.1 |

FOREIGN PATENT DOCUMENTS

| | | | |
|---|---|---|---|
| 0451930 | 9/1950 | Italy | 4/246.1 |
| 0658023 | 10/1951 | United Kingdom | 4/246.1 |

*Primary Examiner*—Robert M. Fetsuga
*Attorney, Agent, or Firm*—Michael I. Kroll

[57] ABSTRACT

A lifting device for a cover and seat on a bowl of a toilet comprising a pivot pin. A structure is affixed to the bottom surface of the cover at a side edge thereof, for extending horizontally the pivot pin away from the side edge of the cover. A handle is also provided. A component at a bottom end of the handle, is for coupling the handle to the pivot pin in a rotatable manner. A hand grip is on a distal free end of the handle. A hand of a person can grasp the hand grip and pull upwards, to lift the cover of the toilet up without bending over the bowl.

3 Claims, 3 Drawing Sheets

LIFTING DEVICE FOR A COVER AND SEAT ON A BOWL OF A TOILET

BACKGROUND OF THE INVENTION

1. Field of the Invention

The instant invention relates generally to toilet seats with covers and more specifically it relates to a lifting device for a cover and seat on a bowl of a toilet.

2. Description of the Prior Art

Numerous toilet seats with covers have been provided in prior art that are adapted to be lifted up by hand when people use the toilets. While these units may be suitable for the particular purpose to which they address, they would not be as suitable for the purposes of the present invention as heretofore described.

SUMMARY OF THE INVENTION

A primary object of the present invention is to provide a lifting device for a cover and seat on a bowl of a toilet that will overcome the shortcomings of the prior art devices.

Another object is to provide a lifting device for a cover and seat on a bowl of a toilet that attaches to the underside of the cover, which enables a person to lift the cover or the cover and seat, without bending over the bowl of the toilet.

An additional object is to provide a lifting device for a cover and seat on a bowl of a toilet in which easy access to lifting the cover or the cover and seat is accomplished by a person who is lazy, or has a back problem.

A further object is to provide a lifting device for a cover and seat on a bowl of a toilet that is simple and easy to use.

A still further object is to provide a lifting device for a cover and seat on a bowl of a toilet that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
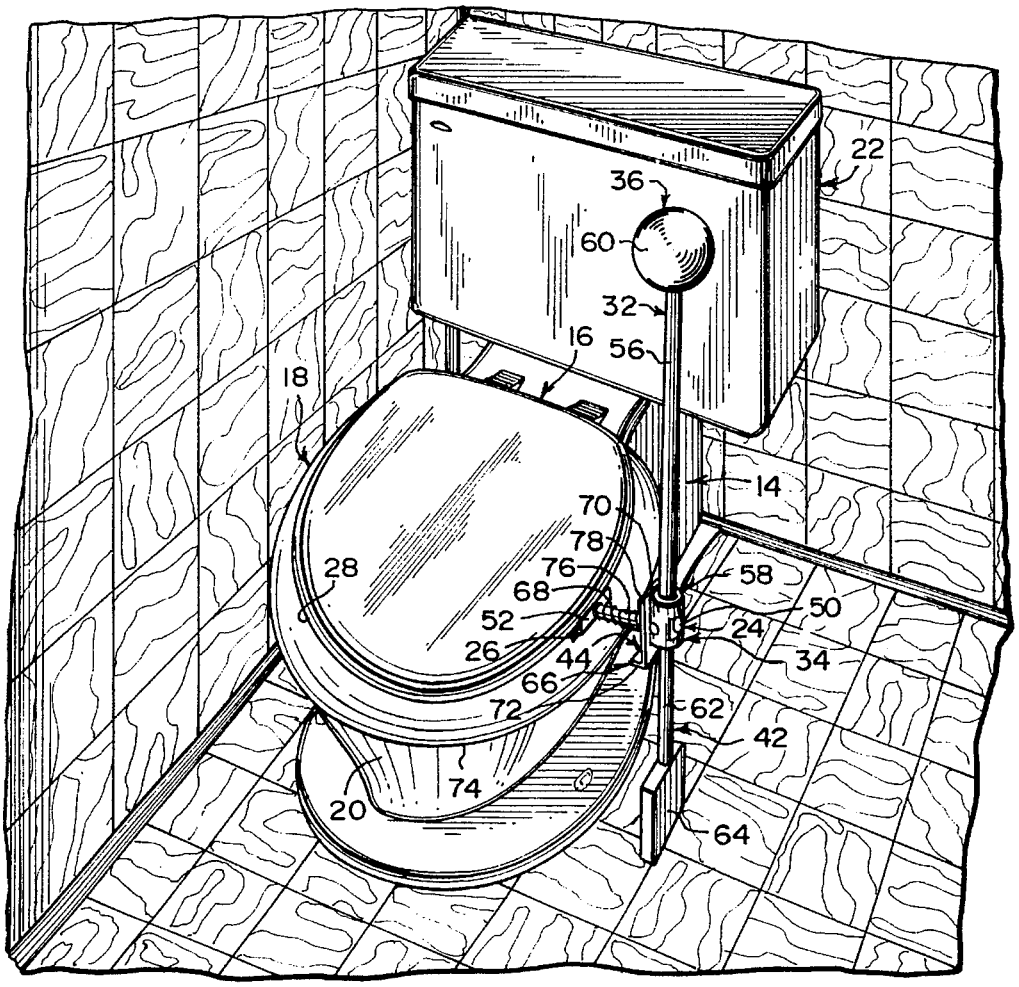
FIG. 1 is a front perspective view, showing the instant invention attached to the underside of a cover of a toilet seat.
Figure 2:
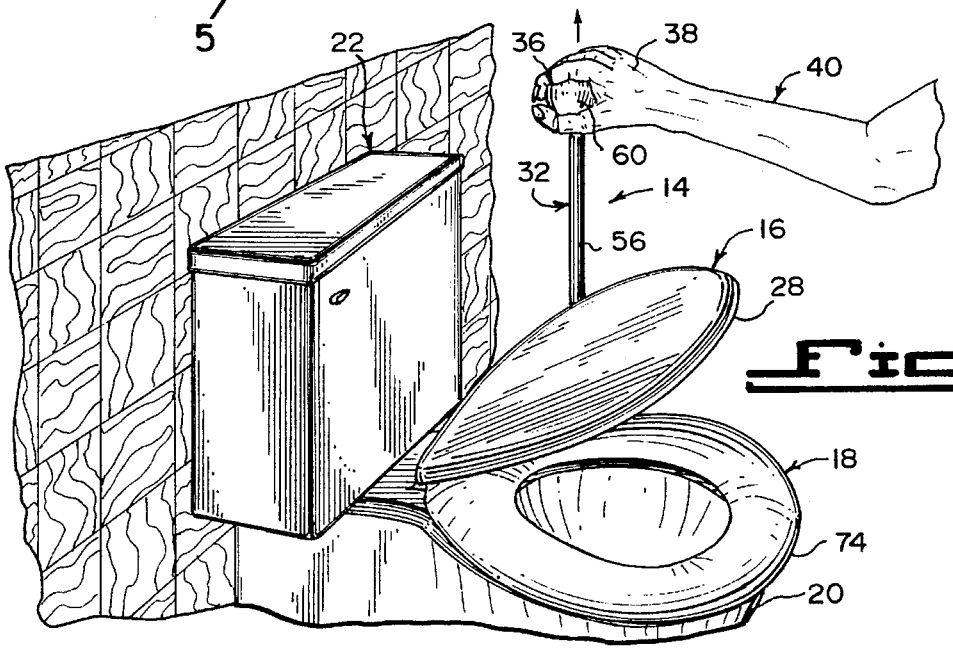
FIG. 2 is a left side perspective view showing the cover of the toilet seat being lifted.
Figure 3:
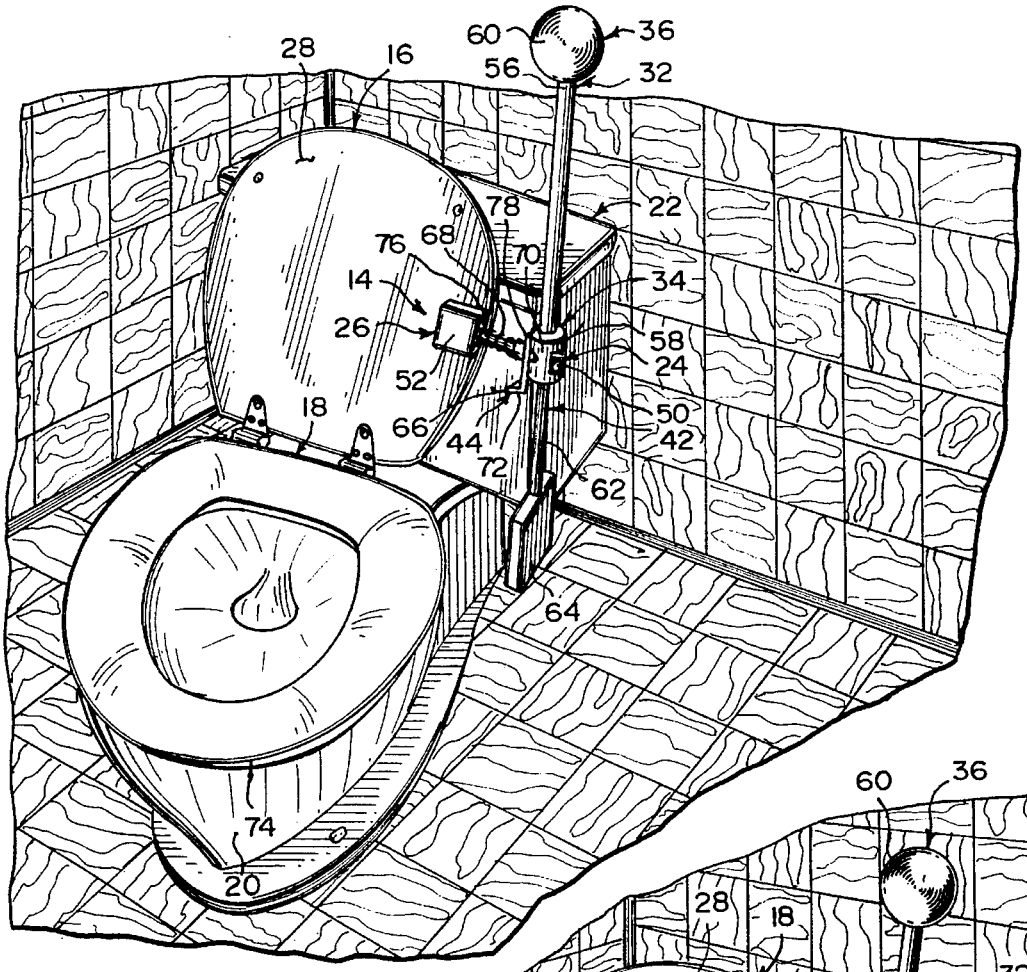
FIG. 3 is a front perspective view similar to FIG. 1, with the cover completely lifted.
Figure 4:
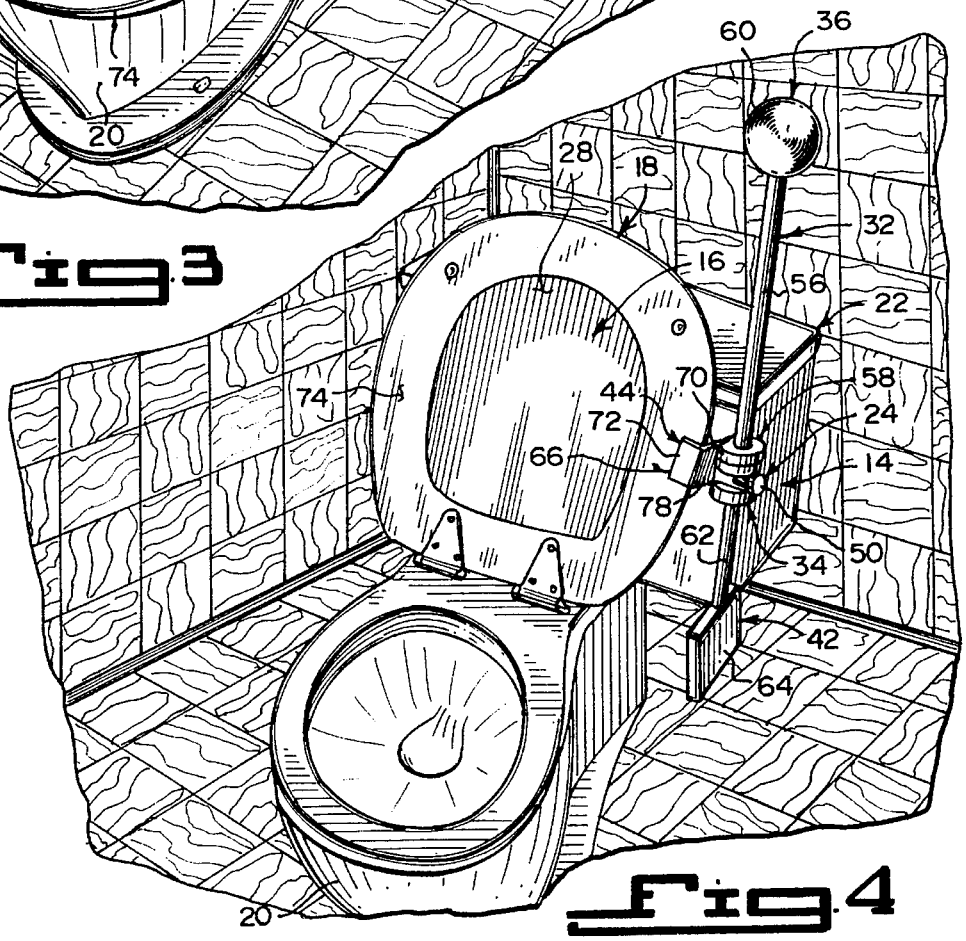
FIG. 4 is a front perspective view similar to FIG. 3, showing the cover and seat completely lifted.
Figure 5:
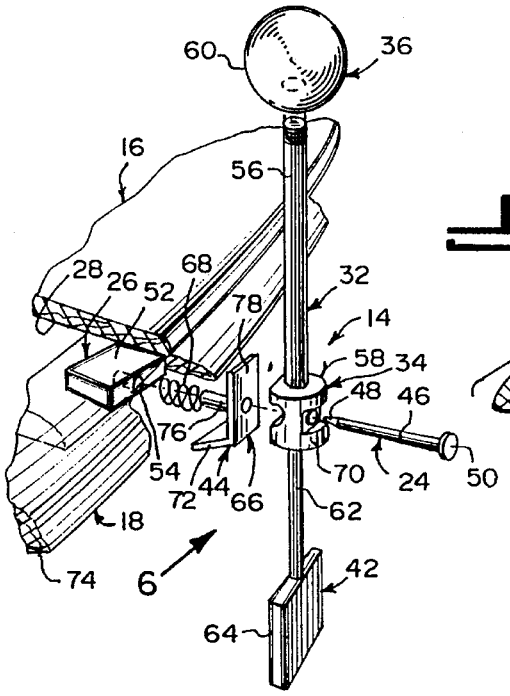
FIG. 5 is an exploded perspective view with parts broken away taken in the direction of arrow 5 in FIG. 1.

Turning now descriptively to the drawings, in which similar reference characters denote similar elements throughout the several views, FIGS. 1 through 12 illustrate a lifting device 14 for a cover 16 and a seat 18 on a bowl 20 of a toilet 22 comprising a pivot pin 24. Means 26 is affixed to the bottom surface 28 of the cover 16 at a side edge 30 thereof, for extending horizontally the pivot pin 24 away from the side edge 30 of the cover 16. A handle 32 is also provided. Means 34 at a bottom end of the handle 32, is for coupling the handle 32 to the pivot pin 24 in a rotatable manner. A hand grip 36 is on a distal free end of the handle 32. A hand 38 of a person 40 can grasp the hand grip 36 and pull upwards to lift the cover 16 of the toilet 22 up, without bending over the bowl 20. (See FIGS. 2 and 3).

An assembly means 42 on the coupling component 34 is for always keeping vertical the handle 32 on the coupling component 34. Means 44 is for selectively contacting the seat 18 of the toilet, so as to lift up simultaneously the seat 18 and the cover 16 of the toilet 22. (See FIG. 4).

The pivot pin 24 includes a shank 46 having a point 48 at one end and an enlarged head 50 at an opposite end. The pivot pin extending structure 26 is a mounting plate 52 having a side bore 54 to receive the pointed end 48 of the pivot pin 24 therein.

The handle 32 is an elongated tube 56. The coupling component 34 is a connector 58, in which the pivot pin 24 extends transversely therethrough. The hand grip 36 is a ball 60 secured to an elongated tube 56.

The handle vertical keeping assembly 42 consists of an arm 62 extending downwardly from the connector 58. A counterweight 64 is on a distal free end of the arm 62.

Figure 7:
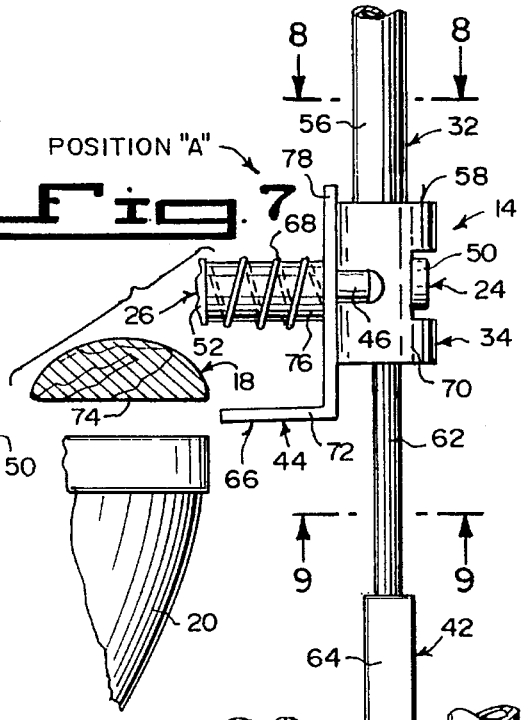
FIG. 7 is an enlarged elevational view similar to FIG. 6, showing the engaging member not in position to lift the seat.
Figure 6:
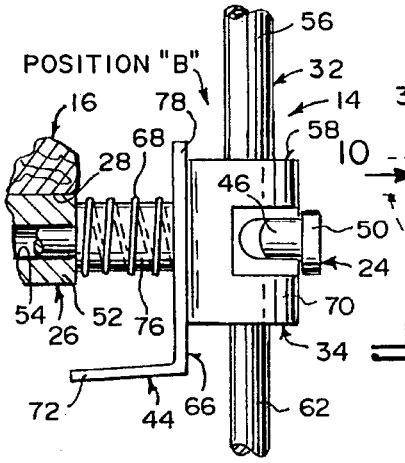
FIG. 6 is an enlarged elevational view taken in the direction of arrow 6 in FIG. 5 with parts broken away and in section, showing the engaging member in position ready to lift the seat.
Figure 8:
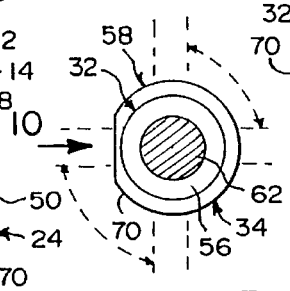
FIG. 8 is a top cross sectional view taken along line 8—8 in FIG. 7, with the engaging member spring and mounting plate removed.
Figure 10:
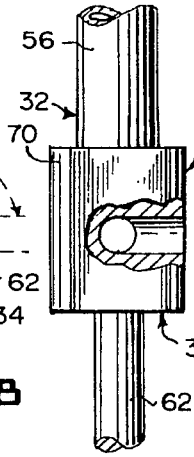
FIG. 10 is a left side elevational view taken in the direction of arrow 10 in FIG. 8, with parts of the connector cam broken away.
Figure 11:
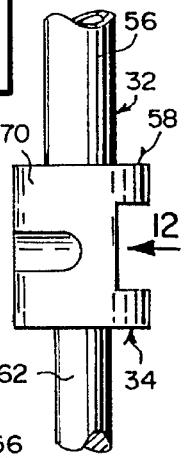
FIG. 11 is a front elevational view taken in the direction of arrow 11 in FIG. 10.
Figure 9:
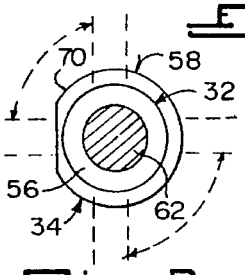
FIG. 9 is a bottom cross sectional view taken along line 9—9 in FIG. 7, with the engaging member, spring and mounting plate removed.
Figure 12:
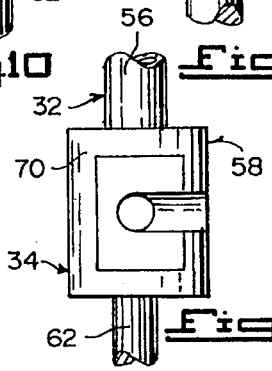
FIG. 12 is a right side elevational view taken in the direction of arrow 12 in FIG. 11.

The toilet seat contacting unit 44 includes an engaging member 66, place in a sliding manner onto the pivot pin 24 between the side of the mounting plate 52 and the connector 58. A spring 68 is positioned between the side of the mounting plate 52 and the engaging member 66, to bias the engaging member 66 towards the connector 58. The connector 58 has a slotted cam 70 formed thereon. When the connector 58 is vertically turned on the pivot pin 24 by twisting the ball 60 about, the cam 70 will cause the engaging member 66 to compress the spring 68 to move towards and make contact with the toilet seat 18, by going from a position "A", as best seen in FIG. 7, to a position "B" in FIG. 6.

The engaging member 66 contains an L-shaped bracket 72, to selectively contact the underside 74 of the toilet seat 18. A horizontal sleeve 76 is affixed onto a vertical leg 78 of the bracket 72, to face the side of the mounting plate 52. The pivot pin 24 will extend through the sleeve 76, while the spring 68 fits over the sleeve 78.

OPERATION OF THE INVENTION

To use the lifting device 14, the following steps should be taken:

1. Grip the ball 60 by the hand 38.

2. Pull up on the ball 60, so that the mounting plate 52 attached to the bottom surface 28 of the cover 16 will lift the cover 16 up.

3. To lift the seat 18, twist the ball 60 by the hand 38, so that the engaging member 66 will move towards the seat 18 by the movement of the cam 70 on the connector 58.

4. Pull up on the ball 60, so that the bracket 72 in engagment with the underside 74 of the seat 18 will lift both the seat 18 and the cover 16 up together.

LIST OF REFERENCE NUMBERS

14 lifting device
16 cover
18 seat
20 bowl
22 toilet
24 pivot pin
26 pivot pin extending structure
28 bottom surface of 16
30 side edge of 16
32 handle
34 coupling component
36 hand grip
38 hand
40 person
42 handle vertical keeping assembly
44 toilet seat contacting unit
46 shank of 24
48 point on 46
50 enlarged head on 46
52 mounting plate
54 side bore in 52
56 elongated tube for 32
58 connector for 34
60 ball for 36
62 arm
64 counterweight
66 engaging member
68 spring
70 slotted cam on 58
72 L-shaped bracket of 66
74 underside of 18
76 horizontal sleeve
78 vertical leg of 72

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A lifting device for a cover and seat on a bowl of a toilet comprising:

a) a pivot pin, said pivot pin includes a shank having a point at one end and an enlarged head at an opposite end;

b) means connectable to the bottom surface of the cover at a side edge thereof, for extending horizontally said pivot pin away from the side edge of the cover, said pivot pin extending means is a mounting plate having a side bore to receive said pointed end of said pivot pin therein;

c) a handle, said handle is an elongated tube;

d) means at a bottom end of said handle, for coupling said handle to said pivot pin in a rotatable manner, said coupling means is a connector in which said pivot pin extends transversely therethrough;

e) a hand grip on a distal free end of said handle, so that a hand of a person can grasp said hand grip and pull upwards to lift the cover of the toilet up, said hand grip is a ball secured to said elongated tube;

f) means on said coupling means for always keeping vertical said handle on said coupling means, said handle vertical keeping means including an arm extending downwardly from said connector, and a counterweight on a distal free end of said arm;

g) means for selectively contacting the seat of the toilet, so as to lift up simultaneously the seat and the cover of the toilet.

2. A lifting device for a cover and seat on a bowl of a toilet as recited in claim 1, wherein said toilet seat contacting means includes:

a) an engaging member placed in a sliding manner onto said pivot pin between the side of said mounting plate and said connector;

b) a spring positioned between the side of said mounting plate and said engaging member, to bias said engaging member towards said connector; and c) said connector having a slotted cam formed thereon, so that when said connector is vertically turned on said pivot pin by twisting said ball about, said cam will cause said engaging member to compress said spring to move towards and make contact with the toilet seat.

3. A lifting device for a cover and seat on a bowl of a toilet a recited in claim 2, wherein said engaging member includes:

a) an L-shaped bracket to selectively contact the underside of the toilet seat; and b) a horizontal sleeve affixed onto a vertical leg of said bracket to face the side of said mounting plate, so that said pivot pin will extend through said sleeve, while said spring fits over said sleeve.

* * * * *